US006396009B1

(12) United States Patent
Yu

(10) Patent No.: US 6,396,009 B1
(45) Date of Patent: May 28, 2002

(54) LAMP RECEPTACLE WITH A MULTIPLE-STAGE POWER ADJUSTING SWITCH

(76) Inventor: Alexander Yu, 10F-1, No. 1, Lane 106, Sec. 3, Min-Chuan E. Rd., Taipei City (TW)

( * ) Notice: Subject to any disclaimer, the term of this patent is extended or adjusted under 35 U.S.C. 154(b) by 0 days.

(21) Appl. No.: 09/840,612

(22) Filed: Apr. 23, 2001

(51) Int. Cl.[7] ..... H01R 13/66

(52) U.S. Cl. ..... 200/51 R; 200/51.17; 439/620; 439/667

(58) Field of Search ..... 200/11 R–11 H, 200/51 R, 51.05, 51.11, 51.14, 51.17, 564, 568, 569, 570, 571; 362/95, 394, 395, 410; 439/336, 613, 615, 620, 76.1, 666, 667, 614, 640, 220, 168

(56) References Cited

U.S. PATENT DOCUMENTS 4,104,565 A * 8/1978 Klassen ..... 200/51.06
4,283,107 A * 8/1981 Anthony ..... 200/51.17
5,113,044 A * 5/1992 Tomberlin ..... 200/51.04
5,514,006 A * 5/1996 Getselis et al. ..... 200/51.17
6,051,801 A * 4/2000 Wang ..... 200/284
6,227,912 B1 * 5/2001 Hung ..... 200/51.17

* cited by examiner

*Primary Examiner*—Michael Friedhofer
(74) *Attorney, Agent, or Firm*—Brinks Hofer Gilson & Lione

(57) ABSTRACT

A lamp receptacle for a screw bulb includes a seat, a multiple-stage power adjusting switch mounted in the seat and having a ratchet wheel and a conductive bridging shroud attached to the ratchet wheel, first and second spring arms selectively in resilient contact with one of the ratchet wheel and the bridging shroud, a third spring arm in electrical contact with the second spring arm and the screw bulb, and a resistor in electrical contact with the bridging shroud and the third spring arm. The switch is turnable among an ON position, where a current can pass through the first, second and third spring arms, a DIM position, where the current can pass through the first spring arm, the resistor and the third spring arm, and an OFF position, where the first spring arm is disconnected from a power supply.

5 Claims, 5 Drawing Sheets

LAMP RECEPTACLE WITH A MULTIPLE-STAGE POWER ADJUSTING SWITCH

BACKGROUND OF THE INVENTION

1. Field of the Invention

This invention relates to a lamp receptacle with a multiple-stage power adjusting switch that is capable of disposing a screw bulb in one of an ON state, a DIM state, and an OFF state.

2. Description of the Related Art

FIGS. 1 and 2 illustrate a conventional lamp receptacle 9 for a screw bulb 90. The lamp receptacle 9 includes a dielectric seat 91 formed with first and second slots 911, 912 and a central recess 913, a multi-stage power adjusting switch 92 having a rod 921 that has one end extending into the central recess 913 and a dielectric ratchet wheel 922 connected to the end of the rod 921, a first conductive plate 93 that is mounted in the first slot 911, that is electrically connected to a power supply (not shown), and that has a first spring arm 931 extending inwardly to the ratchet wheel 922, a second conductive plate 94 mounted in the second slot 912 and having a second spring arm 941 that extends inwardly to the ratchet wheel 922, a dielectric cover 98 attached to a top end face of the seat 91 and formed with a slit 981, a conductive annular connector 95 mounted on the cover 98 and defining a bulb receiving space for receiving a conductive threaded portion 97 of the screw bulb 90, a conductive linking plate 94' that is attached to the cover 98 and that has a third spring arm 942 extending inwardly to the ratchet wheel 922 and a fourth spring arm 943 extending through the slit 981 and into the bulb receiving space in the conductive annular connector 95 so as to resiliently contact the screw bulb 90, a ground terminal 96 mounted on the seat 91 and electrically connected to both the conductive annular connector 95 and the power supply, and a resistor 99 having two opposite ends that are respectively and electrically connected to the conductive linking plate 94' and the second conductive plate 94.

The ratchet wheel 922 has first, second, third, fourth, fifth, and sixth ratchet teeth 9221, 9222, 9223, 9224, 9225, 9226 which are equiangularly spaced apart, and each of which has a radial side 9227 and an inclined side 9228.

The multiple-stage power adjusting switch 92 further includes a conductive bridging shroud 923 that has a central portion attached to a central portion of the ratchet wheel 922, and contact portions 9231 that are respectively attached to the inclined sides 9228 of the first, second, fourth, and fifth ratchet teeth 9221, 9222, 9224, 9225.

The rod 921 is turnable among an ON position, in which, the first spring arm 931 resiliently contacts one of the contact portions 9231 of the bridging shroud 923, and the third spring arm 942 resiliently contacts another one of the contact portions 9231 of the bridging shroud 923 so as to permit current flow through the first conductive plate 93, the first spring arm 931, the bridging shroud 923, the third spring arm 942, the fourth spring arm 943, a tungsten filament (not shown) of the screw bulb 90, the threaded portion 97 of the screw bulb 90, and the ground terminal 96, a DIM position, in which, the first and second spring arms 931, 941 resiliently and respectively contact two opposite ones of the contact portions 9231 of the bridging shroud 923, whereas the third spring arm 942 resiliently contacts one of the third and sixth ratchet teeth 9223, 9226 so as to permit current flow through the first conductive plate 93, the first spring arm 931, the bridging shroud 923, the second spring arm 941, the second conductive plate 94, the resistor 99, the fourth spring arm 943, the tungsten filament of the screw bulb 90, the threaded portion 97 of the screw bulb 90, and the ground terminal 96, and an OFF position, in which, the first spring arm 931 resiliently contacts one of the third and sixth ratchet teeth 9223, 9226 to thereby disconnect the screw bulb 90 from the power supply.

The conventional lamp receptacle 9 is disadvantageous in that the ratchet wheel 922 and the bridging shroud 923 are relative complex, and assembly thereof is laborious. Moreover, each time the rod 921 is turned from a position to another position, there are three jumps, each of which represents a respective one of the first, second, and third spring arms 931 jumping from one of the contact portions 9231 of the bridging shroud 923 and the inclined sides of the third and sixth ratchet teeth 9223, 9226 to an adjacent one of the contact portions 9231 of the bridging shroud 923 and the inclined sides of the third and sixth ratchet teeth 9223, 9226. As a consequence, the possibility of the occurrence of electric arc is increased due to the aforesaid jumps.

SUMMARY OF THE INVENTION

Therefore, it is an object of the present invention to provide a lamp receptacle that is capable of overcoming the aforesaid drawbacks.

According to the present invention, a lamp receptacle for a screw bulb comprises: a dielectric hollow seat having a peripheral wall that confines a central recess, that has a bottom end and a top end with a top face, and that is formed with opposite first and second slots extending in longitudinal directions from the top face to the bottom end and being in spatial communication with the central recess, and a channel extending in a transverse direction relative to the longitudinal directions and being in spatial communication with the central recess; a multiple-stage power adjusting switch including a rod that has a connecting end extending inwardly through the channel and into the central recess, and a dielectric ratchet wheel transverse to and secured to the connecting end of the rod, the ratchet wheel having a central portion that is connected to the connecting end of the rod, and consecutive first, second, third, and fourth ratchet teeth that are angularly disposed around the central portion, each of the first, second, third, and fourth ratchet teeth being defined by a radial side and an inclined side that is inclined relative to the central portion, the multiple-stage power adjusting switch further including a conductive bridging shroud that has a central part attached to the central portion of the ratchet wheel, and opposite first and second contact parts that are transverse to the central part and that are respectively attached to the inclined sides of the first and third ratchet teeth; a first conductive plate mounted in the first slot and having a first spring arm that extends inwardly toward the ratchet wheel so as to contact selectively and resiliently one of the first and second contact parts of the bridging shroud and the inclined sides of the second and fourth ratchet teeth of the ratchet wheel, the first conductive plate being adapted to be connected to a power supply; a second conductive plate mounted in the second slot and having a second spring arm that is opposite to the first spring arm and that extends inwardly toward the ratchet wheel so as to contact selectively and resiliently one of the first and second contact parts of the bridging shroud and the inclined sides of the second and fourth ratchet teeth of the ratchet wheel; a conductive annular connector mounted on the top face of the seat and having a threaded inner face that defines a bulb receiving space and that is adapted to engage the screw bulb threadedly; a third spring arm electrically connected to and extending upwardly and inclinedly relative to the longitudinal directions from the second conductive plate into the bulb receiving space so as to contact resiliently and electrically the screw bulb; a ground terminal mounted on the peripheral wall, electrically connected to the conductive annular connector, and adapted to be electrically connected to the power supply; and a resistor having one end electrically connected to the central part of the bridging shroud and the other end electrically connected to the second conductive plate. The rod is turnable relative to the seat among an ON position, in which, the first and second spring arms contact respectively and electrically the first and second contact parts of the bridging shroud so as to permit current flow through the first and second conductive plates, the third spring arm, the screw bulb, the conductive annular connector, and the ground terminal, a DIM position, in which, the first spring arm contacts one of the first and second contact parts of the bridging shroud electrically whereas the second spring arm contacts one of the inclined sides of the second and fourth ratchet teeth of the ratchet wheel so as to permit current flow through the first conductive plate, the resistor, the third spring arm, the screw bulb, the conductive annular connector, and the ground terminal, and an OFF position, in which, the first spring arm contacts one of the inclined sides of the second and fourth ratchet teeth of the ratchet wheel to thereby disconnect the screw bulb from the power supply.

BRIEF DESCRIPTION OF THE DRAWINGS

In drawings which illustrate an embodiment of the invention.

DETAILED DESCRIPTION OF THE PREFERRED EMBODIMENT

Figure 1:
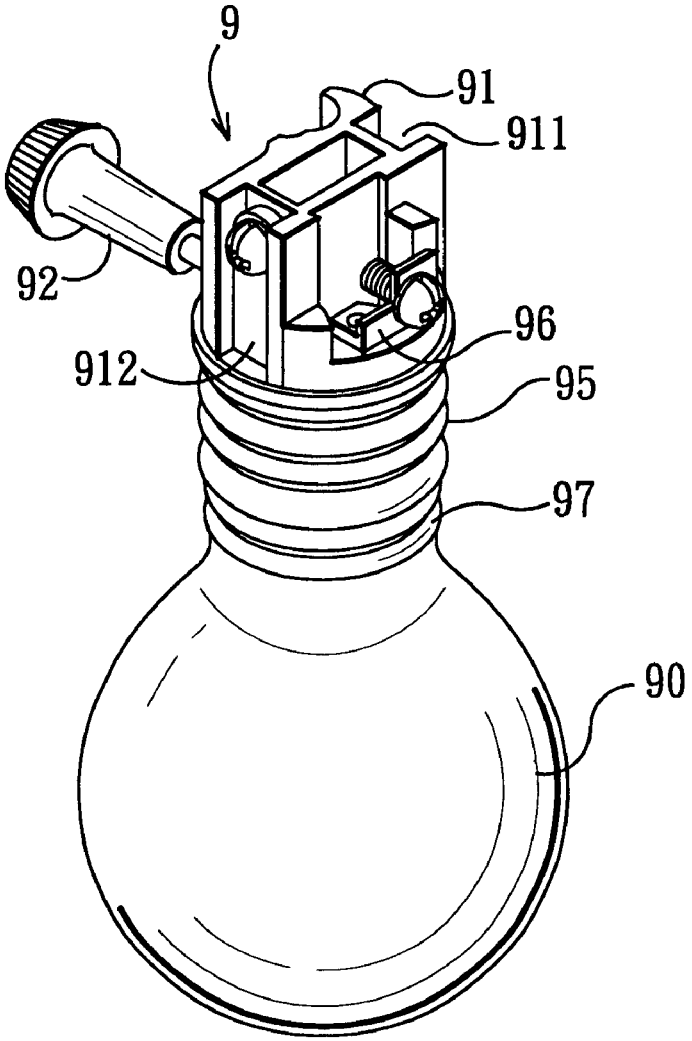
F I G. 1 PRIOR ART
FIG. 1 is a perspective view of a conventional lamp receptacle.
Figure 2:
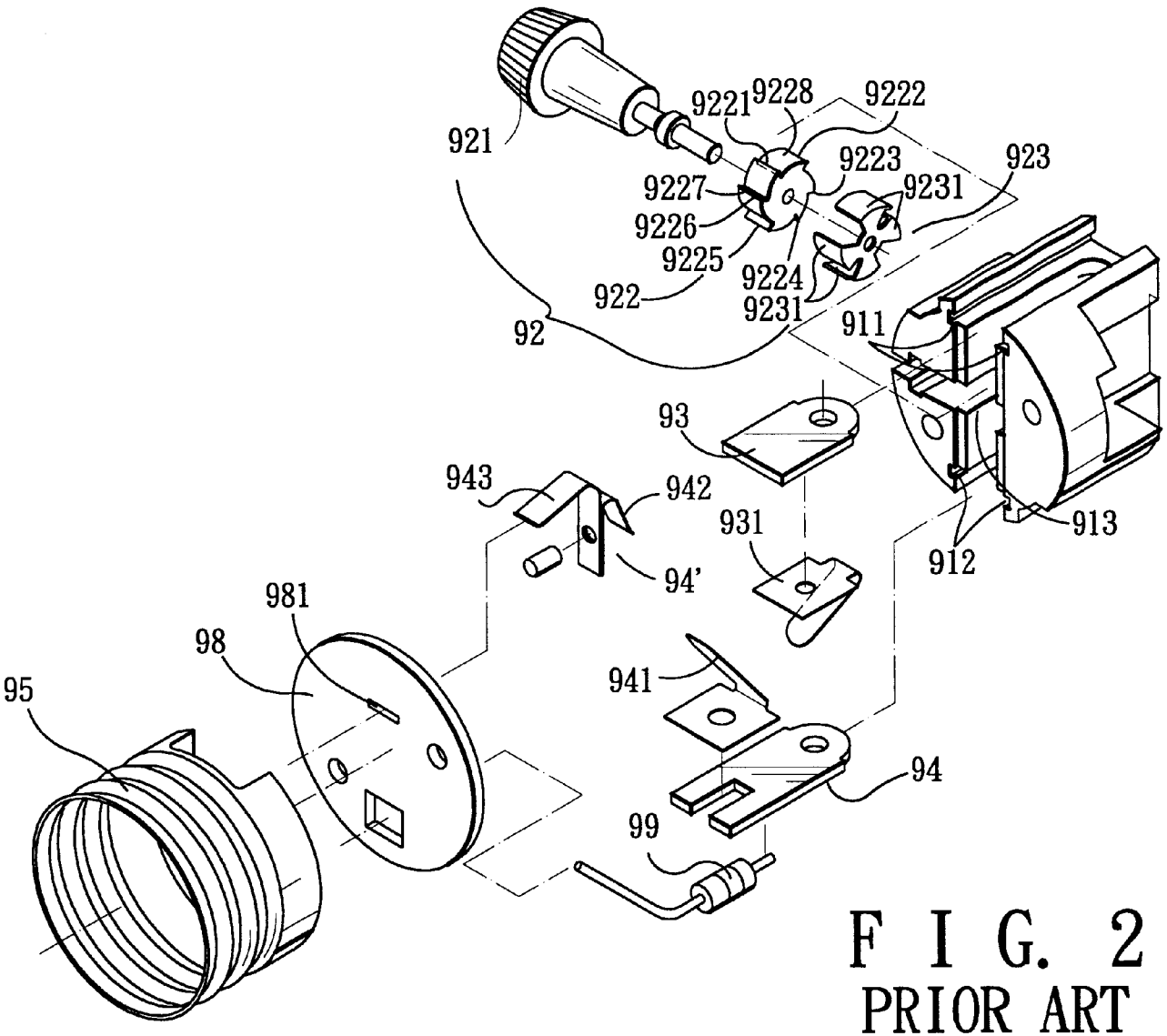
FIG. 2 PRIOR ART
FIG. 2 is an exploded perspective view of the lamp receptacle of FIG. 1.
Figure 3:
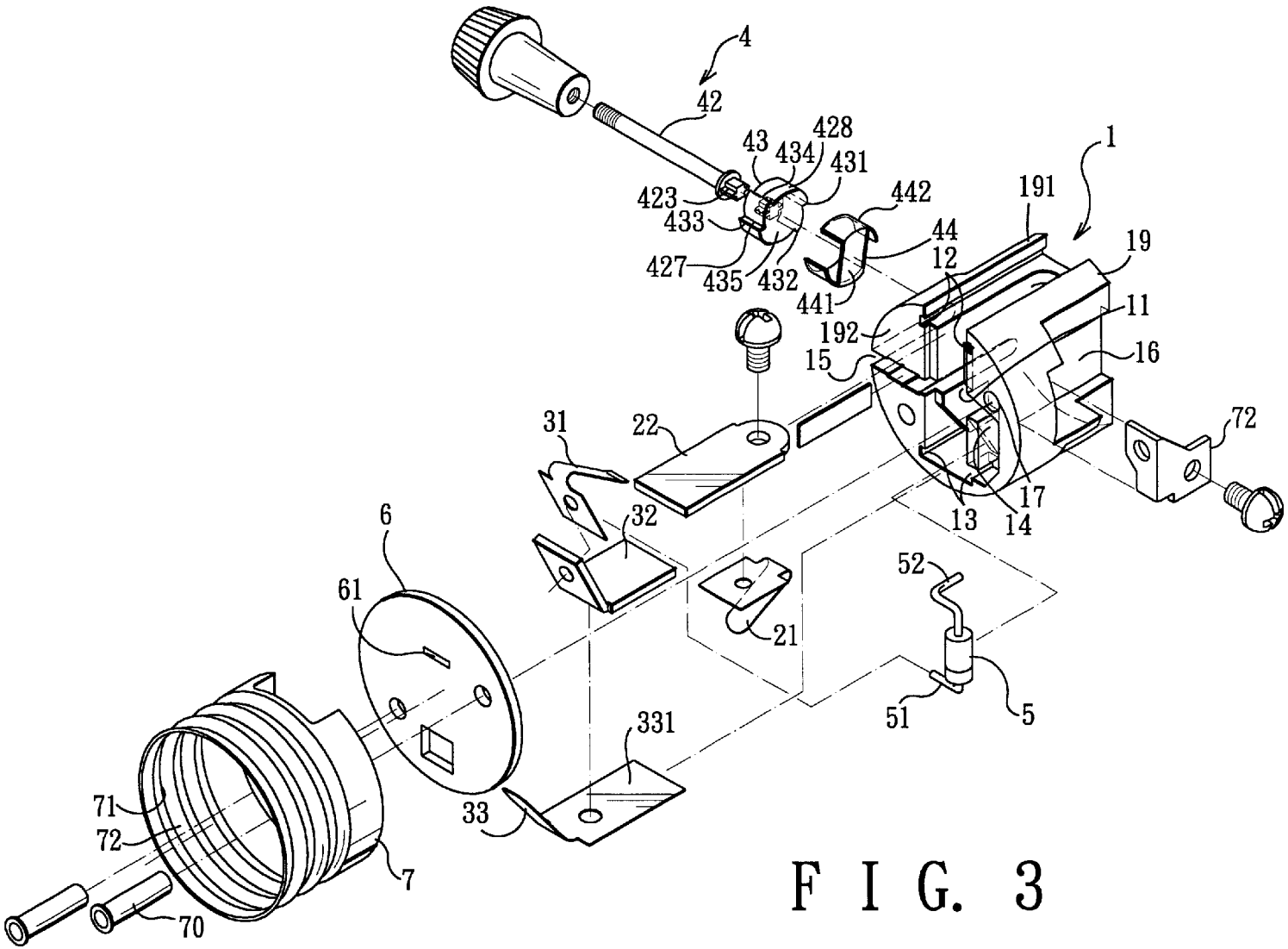
FIG. 3 is an exploded perspective view of a lamp receptacle embodying this invention.
Figure 4:
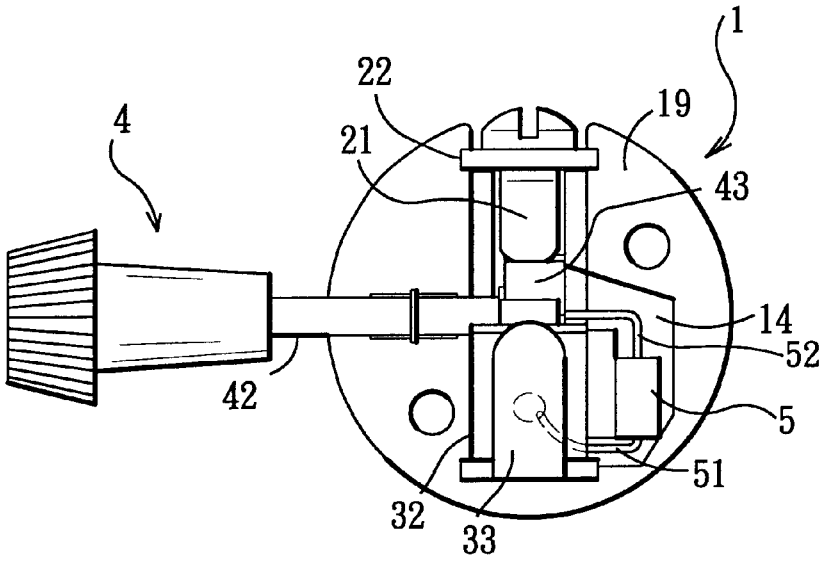
FIG. 4 is a fragmentary top view of the lamp receptacle of FIG. 3.
Figure 5:
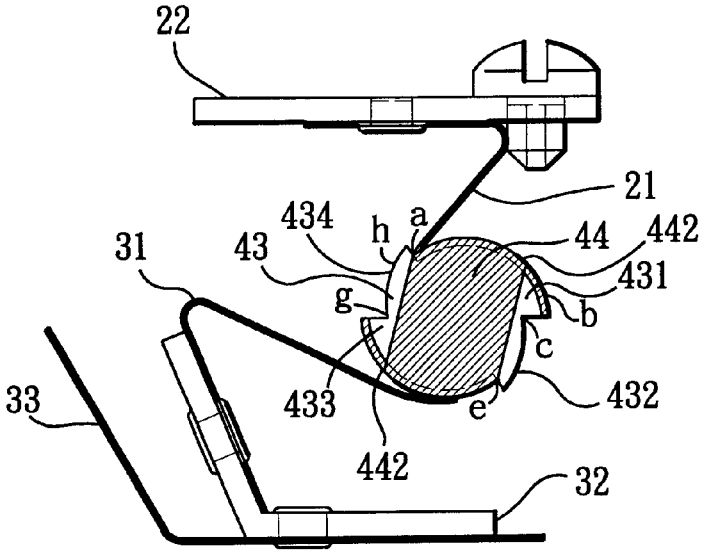
FIG. 5 is another fragmentary top view of the lamp receptacle of FIG. 3.

FIGS. 3 to 5 illustrate a lamp receptacle embodying this invention for a screw bulb (not shown). The lamp receptacle includes: a dielectric hollow seat 1 having a peripheral wall 19 that confines a central recess 11, that has a bottom end 191 and a top end with a top face 192, and that is formed with opposite first and second slots 12, 13 extending in longitudinal directions from the top face 192 to the bottom end 191 and being in spatial communication with the central recess 11, a channel 15 extending in a transverse direction relative to the longitudinal directions and being in spatial communication with the central recess 11, a resistor receiving recess 14 projecting inwardly from the top end face 192, and a ground terminal receiving recess 16 adjacent to the bottom end 191; a multiple-stage power adjusting switch 4 including a rod 42 that has a connecting end 423 extending inwardly through the channel 15 and into the central recess 11, and a dielectric ratchet wheel 43 transverse to and secured to the connecting end 423 of the rod 42, the ratchet wheel 43 having a central portion 435 that is connected to the connecting end 423 of the rod 42, and consecutive first, second, third, and fourth ratchet teeth 431, 432, 433, 434 that are angularly disposed around the central portion 435, each of the first, second, third, and fourth ratchet teeth 431, 432, 433, 434 being defined by a radial side 437 and an inclined side 438 which is inclined relative to the central portion 435, the multiple-stage power adjusting switch 4 further including a conductive bridging shroud 44 that has a central part 441 attached to the central portion 435 of the ratchet wheel 43, and opposite first and second contact parts 442 that are transverse to the central part 441 of the bridging shroud 44 and that are respectively attached to the inclined sides 438 of the first and third ratchet teeth 431, 433; a first conductive plate 22 mounted in the first slot 12 and having a first spring arm 21 that extends inwardly toward the ratchet wheel 43 so as to contact selectively and resiliently one of the first and second contact parts 442 of the bridging shroud 44 and the inclined sides 438 of the second and fourth ratchet teeth 432, 434 of the ratchet wheel 43, the first conductive plate 22 being adapted to be connected to a power supply (not shown); a second conductive plate 32 mounted in the second slot 13 and having a second spring arm 31 that is opposite to the first spring arm 21 and that extends inwardly toward the ratchet wheel 43 so as to contact selectively and resiliently one of the first and second contact parts 442 of the bridging shroud 44 and the inclined sides 438 of the second and fourth ratchet teeth 432, 434 of the ratchet wheel 43; a cover 6 mounted on the top face 192 of the seat 19 and formed with a slit 61; a conductive annular connector 7 mounted on the cover 6 and having a threaded inner face 71 that defines a bulb receiving space 72 and that is adapted to engage the screw bulb threadedly; a third spring arm 33 extending upwardly and inclinedly relative to the longitudinal directions from the second conductive plate 32 through the slit 61 and into the bulb receiving space 72 so as to contact resiliently and electrically the screw bulb and having an extension 331 that is mounted in the second slot 13 and that is secured to the second conductive plate 32; a ground terminal 72 mounted in the ground terminal receiving recess 16 in the peripheral wall 19, electrically connected to the conductive annular connector 7 via a rivet 70, and adapted to be electrically connected to the power supply; and a resistor 5 having one end 52 electrically connected to the central part 441 of the bridging shroud 44 and the other end 51 electrically connected to the second conductive plate 32.

The rod 42 is turnable relative to the seat 19 among an ON position, in which, the first and second spring arms 21, 31 contact respectively and electrically the first and second contact parts 442 of the bridging shroud 44 (the contact positions for the first and second spring arms 21, 31 relative to the ratchet wheel 43 are respectively indicated as "a" and "e" in FIG. 5 ) so as to permit current flow through the first and second conductive plates 22, 32, the third spring arm 33, the screw bulb, the conductive annular connector 7, and the ground terminal 72, a DIM position, in which, the first spring arm 21 contacts one of the first and second contact parts 442 of the bridging shroud 44 electrically whereas the second spring arm 31 contacts one of the inclined sides 438 of the second and fourth ratchet teeth 432, 434 of the ratchet wheel 43 (the contact positions for the first and second spring arms 21, 31 relative to the ratchet wheel 43 are respectively indicated as "b" and "g" in FIG. 5) so as to permit current flow through the first conductive plate 22, the resistor 5, the third spring arm 33, the screw bulb, the conductive annular connector 7, and the ground terminal 72, and an OFF position, in which, the first and second spring arms 21, 31 respectively contact the inclined sides 438 of the second and fourth ratchet teeth 432, 434 of the ratchet wheel 43 (the contact positions for the first and second spring arms 21, 31 relative to the ratchet wheel 43 are respectively indicated as "c" and "h" in FIG. 5) to thereby disconnect the screw bulb from the power supply.

The inclined sides 438 of the first and third ratchet teeth 431, 433 have lengths greater than those of the inclined sides 438 of the second and fourth ratchet teeth 432, 434.

Each of the first and second contact parts 442 of the bridging shroud 44 extends from one end to the other end of the inclined side 438 of a respective one of the first and third ratchet teeth 431, 433.

Figure 6:
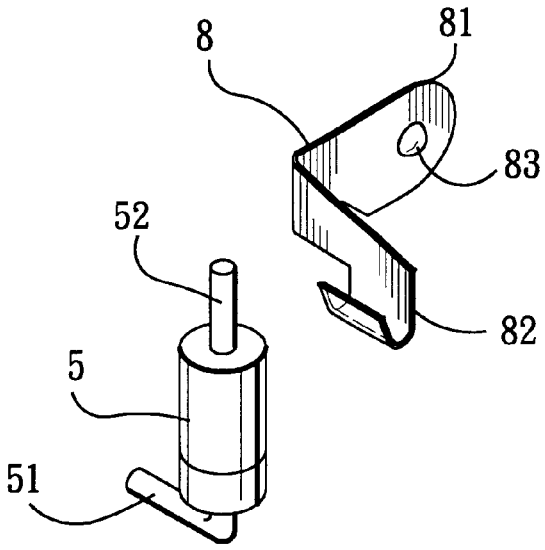
FIG. 6 is a perspective view of a conductive connecting plate for connecting a resistor of the lamp receptacle of FIG. 3.
Figure 7:
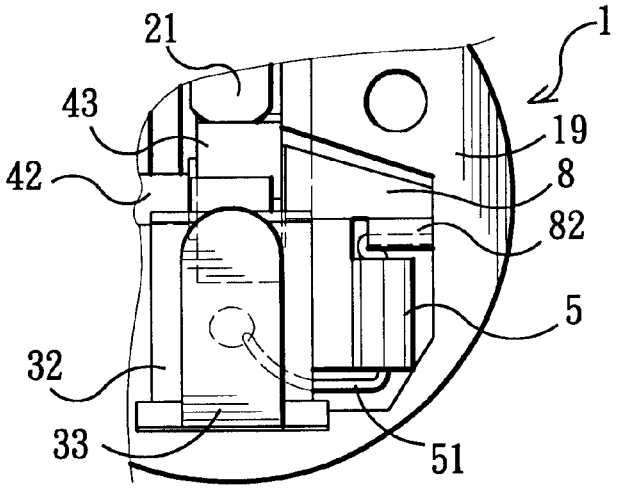
FIG. 7 is a fragmentary top view to illustrate installation of the connecting plate of FIG. 6 on the lamp receptacle of FIG. 3.

Referring to FIGS. 6 and 7, in combination with FIGS. 3 to 5, a conductive connecting plate 8 can be employed to connect the resistor 5 to the central part 441 of the bridging shroud 44. The connecting plate 8 is disposed in the central recess 13, and has an anchored end 82 that is electrically connected to the end 52 of the resistor 5, and a spring arm 81 that extends from the anchored end 82 to the central part 441 of the bridging shroud 44 and that is provided with a protrusion 83 in resilient contact with the central part 441 of the bridging shroud 44.

With the design of the multiple-stage power adjusting switch 4, the first, second and third spring arms 21, 31, 33, and the resistor 5 in the lamp receptacle of this invention, the aforesaid drawback as associated with the prior art can be eliminated.

With the invention thus explained, it is apparent that various modifications can be made without departing from the spirit of the present invention. It is therefore intended that the invention be limited only as recited in the appended claims.

I claim:

1. A lamp receptacle for a screw bulb, comprising:

a dielectric hollow seat having a peripheral wall that confines a central recess, that has a bottom end and a top end with a top face, and that is formed with opposite first and second slots extending in longitudinal directions from said top face to said bottom end and being in spatial communication with said central recess, and a channel extending in a transverse direction relative to said longitudinal directions and being in spatial communication with said central recess;

a multiple-stage power adjusting switch including a rod that has a connecting end extending inwardly through said channel and into said central recess, and a dielectric ratchet wheel transverse to and secured to said connecting end of said rod, said ratchet wheel having a central portion connected to said connecting end of said rod, and consecutive first, second, third, and fourth ratchet teeth that are angularly disposed around said central portion, each of said first, second, third, and fourth ratchet teeth being defined by a radial side and an inclined side that is inclined relative to said central portion, said multiple-stage power adjusting switch further including a conductive bridging shroud having a central part attached to said central portion of said ratchet wheel, and opposite first and second contact parts that are transverse to said central part of said bridging shroud and that are respectively attached to said inclined sides of said first and third ratchet teeth;

a first conductive plate mounted in said first slot and having a first spring arm that extends inwardly toward said ratchet wheel so as to contact selectively and resiliently one of said first and second contact parts of said bridging shroud and said inclined sides of said second and fourth ratchet teeth of said ratchet wheel, said first conductive plate being connectable to a power supply;

a second conductive plate mounted in said second slot and having a second spring arm that is opposite to said first spring arm and that extends inwardly toward said ratchet wheel so as to contact selectively and resiliently one of said first and second contact parts of said bridging shroud and said inclined sides of said second and fourth ratchet teeth of said ratchet wheel;

a conductive annular connector mounted on said top face of said seat and having a threaded inner face that defines a bulb receiving space and that is engages the screw bulb threadedly;

a third spring arm electrically connected to and extending upwardly and inclinedly relative to said longitudinal directions from said second conductive plate into said bulb receiving space so as to contact resiliently and electrically the screw bulb;

a ground terminal mounted on said peripheral wall, electrically connected to said conductive annular connector, and adapted to be electrically connected to the power supply; and a resistor having one end electrically connected to said central part of said bridging shroud and an other end electrically connected to said second conductive plate;

said rod being turnable relative to said seat among an ON position, in which, said first and second spring arms contact respectively and electrically said first and second contact parts of said bridging shroud so as to permit current flow through said first and second conductive plates, said third spring arm, the screw bulb, said conductive annular connector, and said ground terminal, a DIM position, in which, said first spring arm contacts one of said first and second contact parts of said bridging shroud electrically whereas said second spring arm contacts one of said inclined sides of said second and fourth ratchet teeth of said ratchet wheel so as to permit current flow through said first conductive plate, said resistor, said third spring arm, the screw bulb, said conductive annular connector, and said ground terminal, and an OFF position, in which, said first spring arm contacts one of said inclined sides of said second and fourth ratchet teeth of said ratchet wheel to thereby disconnect the screw bulb from the power supply.

2. The lamp receptacle of claim 1, wherein said inclined sides of said first and third ratchet teeth have lengths greater than those of said inclined sides of said second and fourth ratchet teeth.

3. The lamp receptacle of claim 2, wherein said third spring arm has an extension mounted in said second slot and secured to said second conductive plate.

4. The lamp receptacle of claim 3, wherein each of said first and second contact parts of said bridging shroud extends from one end to an other end of said inclined side of a respective one of said first and third ratchet teeth.

5. The lamp receptacle of claim 4, wherein said second spring arm is in contact with the other one of said second and fourth ratchet teeth of said ratchet wheel when said rod is at said OFF position.

* * * * *